US008405693B2

(12) United States Patent
Muhl

(10) Patent No.: US 8,405,693 B2
(45) Date of Patent: Mar. 26, 2013

(54) TRANSPORT APPARATUS FOR FLAT MATERIALS TO BE PRINTED

(75) Inventor: Wolfgang Muhl, Hohen Neuendorf (DE)

(73) Assignee: Francotyp-Postalia GmbH, Birkenwerder (DE)

( * ) Notice: Subject to any disclaimer, the term of this patent is extended or adjusted under 35 U.S.C. 154(b) by 728 days.

(21) Appl. No.: 12/336,852

(22) Filed: Dec. 17, 2008

(65) Prior Publication Data

US 2009/0152809 A1 Jun. 18, 2009

Related U.S. Application Data

(63) Continuation-in-part of application No. 12/201,100, filed on Aug. 29, 2008.

(30) Foreign Application Priority Data

Dec. 17, 2007 (DE) ..... 10 2007 060 788
Jul. 11, 2008 (DE) ..... 10 2008 032 804

(51) Int. Cl.
*B41J 29/02* (2006.01)

(52) U.S. Cl. ..... 347/110; 271/275; 271/198; 198/861.2; 198/861.1

(58) Field of Classification Search ..... 271/275, 271/198
See application file for complete search history.

(56) References Cited

U.S. PATENT DOCUMENTS

| | | | | |
|---|---|---|---|---|
| 5,467,709 | A | 11/1995 | Salomon | |
| 5,813,326 | A | 9/1998 | Salomon | |
| 5,949,444 | A | 9/1999 | Geserich et al. | |
| 6,050,054 | A * | 4/2000 | Van Lierde et al. | 53/284.3 |
| 6,431,778 | B1 * | 8/2002 | Coudray et al. | 400/635 |
| 6,467,901 | B2 * | 10/2002 | Von Inten | 347/104 |
| 6,550,994 | B2 | 4/2003 | Manduley | |
| 6,585,433 | B2 | 7/2003 | Davies et al. | |
| 2002/0127040 | A1 | 9/2002 | Davies et al. | |
| 2003/0016986 | A1 | 1/2003 | Manduley | |
| 2003/0131742 | A1 | 7/2003 | Kanda | |
| 2005/0269395 | A1 | 12/2005 | Miette et al. | |

FOREIGN PATENT DOCUMENTS

| | | | |
|---|---|---|---|
| DE | 196 05 014 | C1 | 3/1997 |
| DE | 196 05 015 | C1 | 3/1997 |
| EP | 109639 | A * | 5/1984 |
| EP | 1 079 975 | B1 | 3/2001 |
| EP | 1 170 141 | B1 | 1/2002 |
| JP | 08336615 | A * | 12/1996 |
| WO | 99/44174 | A1 | 9/1999 |

* cited by examiner

*Primary Examiner* — Mark Robinson
*Assistant Examiner* — Andrew Jordan
(74) *Attorney, Agent, or Firm* — Laurence A. Greenberg; Werner H. Stemer; Ralph E. Locher

(57) ABSTRACT

A transport apparatus for flat materials which are to be printed has a number of spacer pieces which lie axially parallel with respect to one another and are disposed at two ends of a bearing plate of a roller carrier between a first and a second shaped part plate. The bearing plate is equipped with a pull rod for the defined deflection of the roller carrier with corresponding loading of the bearing plate by a mechanical tensile stress which is exerted by the pull rod, and is also equipped with a stressing and setting device, by way of which the tensile stress can be set, which is transmitted through stressing device to the two ends of the bearing plate.

15 Claims, 4 Drawing Sheets

TRANSPORT APPARATUS FOR FLAT MATERIALS TO BE PRINTED

CROSS-REFERENCE TO RELATED APPLICATION

This application is a Continuation-In-Part of copending U.S. application Ser. No. 12/201,100, filed Aug. 29, 2008; this application also claims the priority, under 35 U.S.C. §119, of German Patent Applications DE 10 2007 060 788.3, filed Dec. 17, 2007, and DE 10 2008 032 804.9, filed Jul. 11, 2008; the prior applications are herewith incorporated by reference in their entirety.

BACKGROUND OF THE INVENTION

Field of the Invention

The invention relates to a transport apparatus for flat materials which are to be printed and has a driven transport belt which is mounted on rollers. The invention is used in printing apparatuses which are controlled by microprocessors and is suitable for franking machines and other mail processing units.

In parent U.S. application Ser. No. 12/201,100, filed Aug. 29, 2008, entitled "Transport Apparatus for Flat Materials to be Printed" by the applicant of the instant application Francotyp Postalia GmbH, a transport apparatus is described having a roller carrier on which a flat belt is guided in the manner of a loop. The flat materials are pressed onto the transport belt in a supporting region in the z direction of a Cartesian coordinate system, that is to say counter to the force of gravity. During printing when the flat materials are transported in the x direction, that is to say in the transport direction, a printing image is produced by at least one print head which is moved into a printing position. The transport belt has a width which is broader than the width of a printing window, in the y direction.

The transport apparatus allows the transport belt to be changed with easier installation and dismantling and to adjust the running of the transport belt precisely, which optimizes its running properties and therefore also improves the machine readability of a print of a franked item of mail.

European Patent EP 1 079 975 B1, corresponding to U.S. Pat. No. 6,431,778, discloses a transport principle having a transport belt which lies at the top and a sprung back pressure apparatus which is disposed underneath, between which an item of mail is clamped. A first transport belt which is guided in the manner of a loop between two rollers is disposed above a feed table, over which the items of mail are transported such that they are lying down. That roller of the first transport belt which is disposed downstream in the mail stream is its drive roller. Two deflecting cylinders are disposed between the two rollers, it being possible for the deflecting cylinder which is disposed downstream to be set through the use of a screw in order to set the belt tension. The feed table has openings, through which in each case one back pressure roller which is suspended in a sprung manner reaches through onto the item of mail upstream and downstream. A second belt runs over the suspended back pressure rollers, over at least one unsuspended roller and over a drive roller of the second transport belt.

U.S. Pat. No. 6,550,994 discloses a franking machine having a mail item transport apparatus, by way of which the letters are transported through the franking machine through the use of a transport belt which lies at the top and a plurality of sprung levers which are disposed underneath. Similar facts are also apparent from U.S. Pat. Nos. 5,813,326, 6,776,089 and 6,585,433. The transport belt is mounted in the manner of a loop on rollers, but does not allow the printing module or a part thereof to protrude into the region between the rollers. The width of the transport belt is relatively small and is approximately 1 inch. The extent of the housing transversely with respect to the mail item transport direction is relatively great in contrast. In addition, a second printing position is provided for printing the franking strips which are rolled up on reels and are unrolled for printing. The second printing path causes higher manufacturing costs.

U.S. Pat. No. 5,467,709 has already proposed a printing apparatus for an inkjet franking machine, a franking imprint being printed through the use of an inkjet print head onto an item of mail during approximately horizontal letter transport. For printing, the inkjet print head is disposed in a stationary manner in a recess behind a guide plate. A circulating transport belt which is likewise disposed on the side of the guide plate serves as a transport apparatus. A supporting and pressing apparatus having a plurality of rollers is disposed on the other side opposite the guide plate, with the result that a supplied item of mail is clamped between the rollers of the supporting and pressing apparatus and the circulating transport belt. However, the apparatus cannot avoid oblique running of the printing media. Even an insufficiently tensioned transport belt or an orientation which is not exactly parallel to the axes of those rollers, on which the transport belt circulates, entails the abovementioned risk. The supporting and pressing apparatus is very complicated as a result of its multiplicity of rollers.

German Patent DE 196 05 015 C1, corresponding to U.S. Pat. No. 5,949,444, has already disclosed an embodiment for a printing apparatus of an inkjet franking machine JET-MAIL® from the applicant Francotyp-Postalia AG & Co., which embodiment carries out franking printing, in the case of non-horizontal approximately vertical letter transport, through the use of an inkjet print head which is disposed in a stationary manner in a recess behind a guide plate. A circulating transport belt serves as the transport apparatus, which transport belt has pressing elements for the items of mail (letters up to 20 mm thickness, DIN B4 format) or for franking strips which are configured such that they can be adhesively bonded onto packages of any desired thickness. The printing medium (letter, postcard, franking strip) is clamped between the pressing elements and the guide plate.

Transport and drive apparatuses of simpler construction have also already been proposed without a back pressure apparatus (German Patent DE 196 05 014 C1) or with a back pressure apparatus (International Publication No. WO 99/44174) in the vicinity of the printing region of at least one inkjet print head. The latter is disposed downstream in the mail stream and transport direction of an intake roller pair in International Publication No. WO 99/44174, the upper roller being driven and the lower back pressure roller being sprung. A further roller pair downstream in the mail stream of the inkjet print head near the ejection device likewise exerts a force on the print medium. The printing region is spaced apart from the force transmission region of one of the roller pairs by more than the radius of the respectively driven roller. Although the printing information can be changed in principle in all regions by digital printing, high quality printing is difficult the higher the transport speed which is selected. In particular, during the use of two inkjet print heads, an offset can occur in the printed image (connection error) along a printing length in the transport direction, which offset makes it difficult to evaluate the printed image by machine. The action of force of the further roller pair downstream in the mail stream of the inkjet print head near the ejection device leads to different path lengths and thus to the connection error in the printed image in the case of two inkjet print heads which are offset with respect to one another. The print quality which is demanded in the context of current mail deliverer programs, for example the Information Based Indicia Program of the USPS, would therefore be achievable only at a low printing speed. The low thickness of the printing media which can be printed by a printing apparatus of such simple construction is also disadvantageous.

An apparatus which is known from European Patent EP 1 170 141 B1, corresponding to U.S. Pat. No. 6,467,901, for printing a printing medium in the printing region uses a driven transport drum and nondriven back pressure rollers in the force transmission region or, as an alternative, a nondriven back pressure conveyor belt. A stationary inkjet print head prints the printing medium which is moved downstream in the printing region, the inkjet print head being disposed axially with respect to the transport drum. The printing region is preferably approximately 1 inch and is spaced apart from the force transmission region, the spacing of the most remote pixel from the edge of the transport drum being smaller than the radius of the circumference of the transport drum. However, the light approximately linear contact of the mail item surface which is to be printed with the transport drum and an intake wheel for mail items which is disposed at a spacing are disadvantageous. The intake wheel is driven by the transport drum through a toothed belt. This causes a $\Delta x$ offset of the dots in the printed image. Orthogonally with respect to this, a $\Delta y$ offset of the dots in the printed image occurs, in particular in the case of very large format mail items. Moreover, the construction causes high manufacturing costs.

In the market segment of the franking machines having a small to medium mail item throughput, a compact transport apparatus for mail items which can be dismantled easily is required with manufacturing costs which are as low as possible.

SUMMARY OF THE INVENTION

It is accordingly an object of the invention to provide a transport apparatus for flat materials to be printed, which overcomes the hereinafore-mentioned disadvantages of the heretofore-known devices of this general type and in which a roller carrier of the transport apparatus in a printing apparatus for flat materials makes simple adjustment possible for setting a belt running track and ensures reliable mounting of rollers. An optimum belt tension is to be set automatically in the case of a transport belt which can be changed easily.

With the foregoing and other objects in view there is provided, in accordance with the invention, a transport apparatus for flat materials which are to be printed. The transport apparatus contains rollers, a driven transport belt mounted on the rollers, a roller carrier having a bearing plate with a first end and a second end, a first shaped part plate, a second shaped part plate, a first number of spacer pieces disposed on a first side between the first end of the bearing plate of the roller carrier and the first shaped part plate, a second number of spacer pieces disposed on a second side between the second end of the bearing plate and the second shaped part plate, a pull rod having a stressing and setting device, and a stressing device attached to the first and second ends of the bearing plate and configured for a transmission of force from the pull rod. A mechanical tensile stress is transmitted through the stressing device to the first and second ends of the bearing plate for a defined deflection of the roller carrier with corresponding loading of the bearing plate. The stressing and setting device of the pull rod is provided for setting the mechanical tensile stress.

Despite low manufacturing costs, the reliability of the printing apparatus is to be as high as possible, and an inexpensive construction and simple mounting of the roller carrier are to be made possible.

A metal chassis and at least one motor are constituent parts of a drive apparatus for the transport apparatus of the printing system, this division into a drive apparatus and into a transport apparatus first of all make possible a compact transport apparatus of this type which can be dismantled easily and the constituent part of which a roller carrier is. A premounted roller carrier of the transport apparatus, which roller carrier is mounted removably on the metal chassis, has a drive roller and a first deflecting roller at the end on the output side of the mail stream, that is to say at its end which lies to the right, and a driven roller and a second deflecting roller for a transport belt at the end on the input side, that is to say at its end which lies to the left, which transport belt is guided in the manner of a loop by the rollers in the mounted state. There is provision for a first number of spacer pieces to be provided on one side between one end of a bearing plate of the roller carrier and a first shaped part plate. A second number of spacer pieces are provided on the other side between another end of the bearing plate and a second shaped part plate. In each case one stressing device is attached to the ends of the bearing plate of the roller carrier and to be configured for the transmission of force from a pull rod. A mechanical tensile stress is transmitted through the stressing device to the two ends of the bearing plate for the defined deflection of the roller carrier with corresponding loading of the bearing plate, which mechanical tensile stress counteracts a mechanical tensile stress which is exerted on the roller carrier by the transport belt, and the pull rod having a stressing and setting device, by way of which the tensile stress can be set.

The premounted roller carrier can be completed with the transport belt and further parts to form a transport apparatus and has the now described advantages. First, inexpensive construction and simple mounting, second reliable mounting by a one-sided bearing plate, third stable low torsion bearing of the shaped part plates, fourth optimum transport belt tensioning is present despite a transport belt which can be changed easily, and fifth simple adjustment, for setting the transport belt running track.

Reliable bedding of the rollers is ensured by the fact that two shaped part plates which are fastened on a bearing plate through spacer pieces are provided at the ends of the roller carrier, the bearing plate carrying in each case three spacer pieces at each of its two ends. Downstream in the mail stream, two bearing shafts and a spacer column are provided as spacer pieces. Stable and low torsion mounting of the shaped part plates at the two ends through the spacer pieces is achieved by the contact of two shaped part plates at in each case three points and subsequent three point fastening. Although a first and second shaped part plate are fastened in each case to the two ends of the bearing plate through the spacer pieces, they are not fastened to the metal chassis of the printing unit. This lack of fastening of the shaped part plates to the metal chassis and a centrally inserted region for weakening the structure of the bearing plate of the roller carrier makes it possible for the roller carrier to be deflected in the event of corresponding loading of the rollers by a first tensile stress force F1 which is exerted by the mechanical tensile stress in the case of a mounted transport belt. A second tensile stress force F2 which is applied by a pull rod which is mounted on the outer side of the bearing plate counteracts the first tensile stress force F1.

The metal chassis is configured as a metal chassis having a base plate, having two side walls which are angled away from the former orthogonally, and having two transverse rods which lie in the frame transversely with respect to the transport direction x for flat materials and are mounted in the y direction in each case on a bracket of a side wall, which bracket is angled away inward at right angles. The base plate, the side walls and the two transverse rods are fastened to a rear wall of the frame.

At their other end which is remote from the rear wall, the two transverse rods have in each case a receiving device, for example in each case a receiving hole in the y direction of their axes, or other device.

The transport apparatus is received through the abovementioned two receiving devices which are a constituent part of the transverse rods of the frame and are disposed in the y direction, and are fastened, preferably screwed, on the end side through the use of a releasable fastening, for example through the use of receiving holes of the transverse rods or on their axles with an external thread. Moreover, a drive shaft is provided parallel to the transverse rod, which drive shaft is mounted in each case in a bearing on the rear wall and on that bracket of the right hand wall of the frame which is angled away inward at right angles, a drive pinion being fastened to that end of the drive shaft which is remote from the rear wall. When the transport apparatus is pushed onto the two receiving devices, the drive pinion engages positively into a crown gear on the drive roller of the transport apparatus. A flat belt serves as transport belt, for example.

The stationary bearing shafts do not have to be disposed accurately axially parallel to one another in an expensive manner. In addition, the bearing plate does not have to be readjusted in the case of a higher belt tension because the tensile stress force F2 which is exerted by the pull rod compensates for the first tensile stress force F1 and therefore for the deflection in the event of correct adjustment. This advantageously makes an inexpensive and simple construction possible. No additional adjustable belt track elements have to be used. All existing bearing shafts, on which the deflecting rollers run, likewise act at the same time as belt track elements.

Other features which are considered as characteristic for the invention are set forth in the appended claims.

Although the invention is illustrated and described herein as embodied in a transport apparatus for flat materials to be printed, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
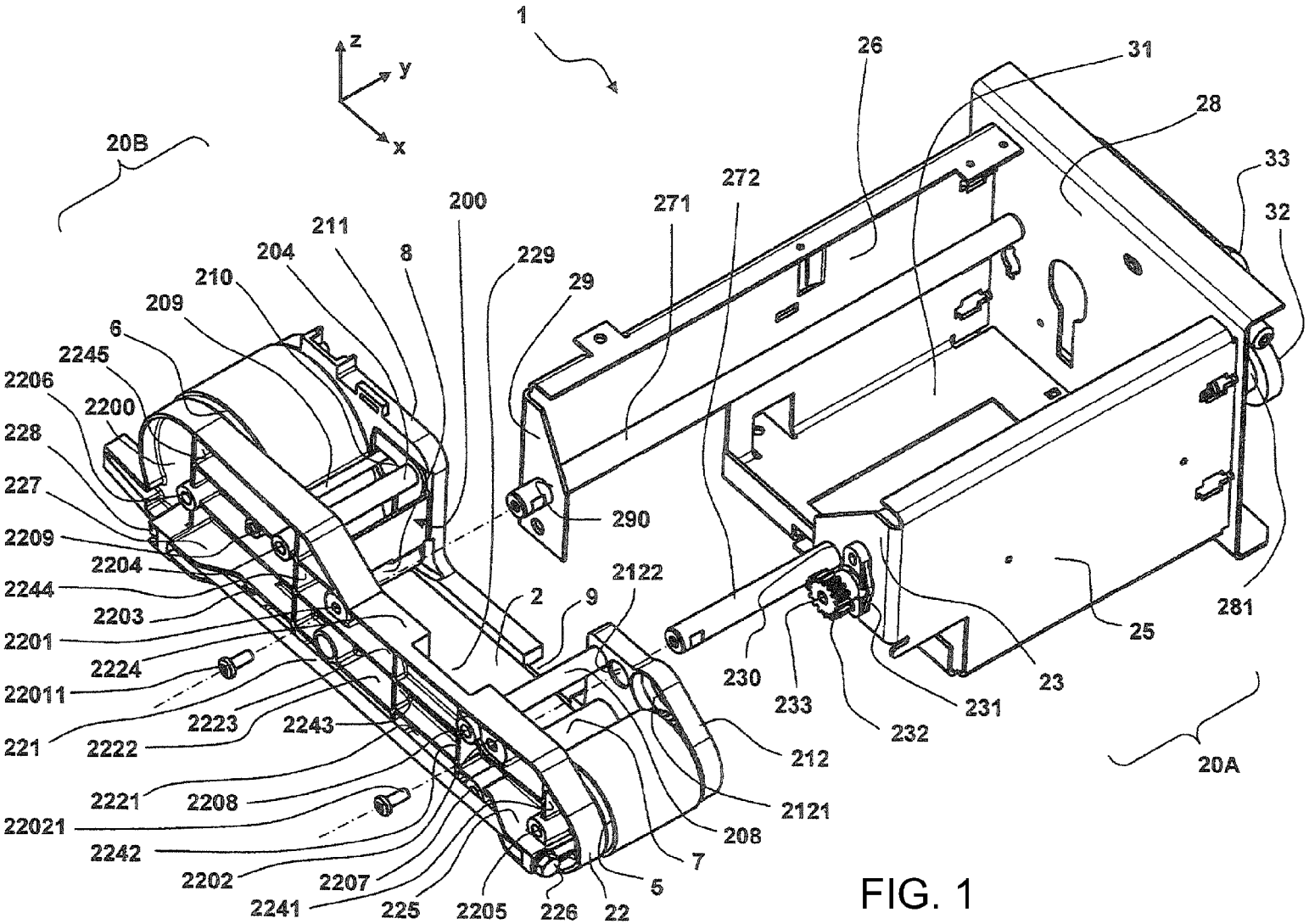
FIG. 1 is a diagrammatic, exploded, perspective view of a proposed transport apparatus and a drive apparatus of the transport apparatus of a printing system, as seen from the top front right and according to the invention.

Referring now to the figures of the drawings in detail and first, particularly, to FIG. 1 thereof, there is seen a perspective view of a proposed transport apparatus and a drive apparatus of the transport apparatus of a printing system, as seen from the top front right in an exploded illustration. A drive apparatus 20A of a transport apparatus 20B of a printing system 1 includes a base plate 31 of a metal chassis and a gear mechanism and drive device which are disposed on the base plate 31. The gear mechanism and drive device include at least one worm gear 32 and a motor 33 having a corresponding force non-illustrated transmission device. As an alternative, the worm gear 32 can be reincorporated by a pulley wheel, toothed pulley wheel or equivalent device.

In the example which is shown, a spacing between the gear mechanism and drive device and the transport apparatus is bridged by a shaft 233 on the metal chassis, the spacing resulting from the dimensions of the printing apparatus. For example, a non-illustrated ink printing apparatus is used which has a printing carriage for a printing module. Moreover, a non-illustrated drive apparatus of the printing carriage is then disposed on the metal chassis.

The metal chassis of the drive apparatus 20A of the transport apparatus of the printing system is configured, for example, as a frame, including the base plate 31 having side walls 25, 26 which are angled away inward in a U-shape by 90°, a right hand side wall 25 merging into a bracket 23 which is angled away inward toward the front side by 90°, and a left hand side wall 26 merging into a bracket 29 which is angled away inward toward the front side by 90°. The base plate 31, the right hand side wall 25 and the left hand side wall 26 are fastened to a rear wall 28. Two equally long transverse rods 271, 272 which are guided through to the front through in each case one hole 230, 290 in the bracket 23, 29 are fastened to the rear wall 28, for example by screws. The transverse rods 271, 272 serve first for guidance during movement of the printing carriage transversely with respect to the transport direction and second for fastening the roller carrier of the transport apparatus 20B for non-illustrated mail items or other flat materials which are to be printed. In this case, the word "flat" relates to the dimension of the material in the z direction of a Cartesian coordinate system. The transport direction is the x direction. The transverse rods 271, 272 lie transversely with respect to the transport direction, that is to say parallel to the y direction, and the printing system 1 stands on a table or is disposed above the table in the z direction within a franking machine or another processing unit for flat materials.

The roller carrier of the transport apparatus 20B is plugged onto the transverse rods 271, 272 of the frame of the printing system and fastened. The transport belt 2 which is mounted on the roller carrier is driven through a drive roller 5 which has an external toothing system at its one end. The drive energy is supplied by a drive pinion 232 which is fastened on a drive shaft 233 and is in engagement with the external toothing system as soon as the roller carrier is plugged onto the transverse rods 271, 272. The drive shaft 233 is mounted rotatably in a first bearing 231 of the bracket 23 and in a second bearing 281 of the rear wall 28.

The left hand side wall 26 has a greater length in the y direction than the right hand side wall 25, the angled away bracket 29 of the left hand side wall 26 pointing in the x direction (transport direction) and the angled away bracket 23 of the right hand side wall 25 pointing counter to the x direction.

The roller carrier of the transport apparatus 20B includes a bearing plate and two shaped part plates, the shaped part plates 211, 212 and a bearing plate 22 being spaced apart from one another through spacer pieces (partially concealed) in accordance with the width of the transport belt 2.

The angled away bracket 23 of the right hand side wall 25 reaches as far as the shaped part plate 212 and that the bracket 29 of the left hand side wall 26 which is angled away in the x direction reaches as far as the inner side of the bearing plate 22. At the top, the shaped part plate 212 has a first opening 2121 for receiving the drive pinion 232 and an adjacent second opening 2122 for plugging through the transverse rod 272 of the right hand bracket 23.

In the upper region, the bearing plate 22 has openings 2201 and 2202 for releasably fastening the bearing plate 22 to the transverse rods 271, 272 through the use of screws 22011 and 22021.

As an alternative, the fastening can also be carried out through locking washers, securing split pins or completely differently, the fastening of the bearing plate 22 remaining releasable, however.

A spacer piece 203 which is disposed at the bottom and can be seen to the first shaped part plate 211 or a spacer piece 208 which is disposed at the top to the second shaped part plate 212 is configured as a spacer column. In the lower and upper regions, the bearing plate 22 has openings 2203 and 2208, respectively, for fastening the spacer columns. Press or shrink joints are preferably provided. As an alternative, the spacer columns can have holes with an internal thread or journals with an external thread at their ends for fastening through the use of non-illustrated screws or nuts. As an alternative, the fastening can also take place completely differently in a form-locking and force-locking way. The ends of the spacer columns are adapted thereto and shaped accordingly.

A spacer piece 204 to the first shaped part plate 211 is configured as a spacer column and serves at the same time as a bearing shaft for a rocker 200. In the upper region, the bearing plate 22 has an opening 2204 for fastening the spacer column. The facts with respect to the embodiment which have already been mentioned above apply to the fastening.

The spacer pieces are all connected to the one bearing plate, in each case three spacer pieces being disposed in a fixed manner and concentrated at each of the two ends of the bearing plate. In this case, in each case two bearing shafts and one spacer column are provided as spacer pieces.

In the central region, the bearing plate 22 has openings 2205 and 2206 for fastening the bearing shafts of the rollers 5 and 6. The facts with respect to the embodiment which have already been mentioned above likewise apply to the fastening. At their two ends, the rollers have in each case one inwardly disposed bearing (not visible). Needle bearings or ball bearings can advantageously be used, in order to reduce the rolling resistance.

A first deflecting roller 8 is disposed next to the driven roller 6 between the first shaped part roller 211 and the bearing plate 22, and a second deflecting roller 7 is disposed next to the drive roller 5 between the second shaped part plate 212 and the bearing plate 22. As a result, the transport belt 2 is guided in the manner of a loop in such a way that a sufficiently large intermediate space is produced between the deflecting rollers for the non-illustrated printing module which is moved into a printing position. The first deflecting roller 8 is disposed rotatably on the rocker 200 which is mounted in a space saving manner between the first shaped part 211 and the bearing plate 22 because at least the first shaped part 211 has a cavity 210 which is formed in the inner wall and is required for moving the rocker 200 if the transport belt is mounted on the roller carrier 20. The bearing plate 22 carries a number of rollers, on which the transport belt 2 is tensioned. The transport belt 2 is configured as a flat belt. The flat belt of the mail item transport apparatus 1 has a great transverse rigidity and is guided over two outer drive and driven rollers 5 and 6 which are covered partially by the bearing plate 22 and are disposed in each case at the ends of the bearing plate and shaped part plate. In this case, the flat belt runs through first under the downwardly pointing supporting surface of a supporting plate 9 and is second guided back between the printing module which is moved into the printing position and the upwardly pointing surface of the supporting plate.

In the zx plane, the bearing plate 22 has a smooth base plate 2200 with frame elements 2241, 2242, 2243 . . . **224*i* which extend in the z direction and are shaped out to the front and with ribs 2221, 2222, 2223 . . . 222*j* which extend in the x direction, for the purpose of reinforcing and producing a sufficient torsional rigidity, and the bearing plate 22 has, moreover, a stressing device 225, 227 and stressing and setting device 226, 228 as well as a pull rod 221 on the front side, in order to absorb the tensile forces which act on the bearing plate 22 during tensioning of the transport belt 2 and in order to compensate for or set the torsion or deflection of the bearing plate in a defined manner. In the example which is shown, the ribs 2221 and 2224 form, in the region of the intermediate space, an edge strip which is bent forward and has a compartment-shaped weak point 229 of the structure with a reduced width of the upper edge strip, the width of the weak point increasing gradually on the base plate 2200 starting from the transition to the first rib 2221 as far as the transition to the fourth rib 2224, the fourth rib 2224** forming the upper edge strip in the region of the intermediate space.

In the example which is shown, only one weak point 229 is situated between the second frame element 2242 and the third frame element 2243. As an alternative, embodiments of the bearing plate having a multiplicity of frame elements are possible, one or more weak points being machined at the same or a different location of the structure of the bearing plate, in order to ensure bending of the bearing plate 22 in a defined way during tensioning of the transport belt 2.

The bearing plate 22 carries a first journal having the first opening 2201 for the fastening of the bearing plate 22 to the first transverse rod 271, the journal being disposed first between the third rib 2223 and the fourth rib 2224 and second between the third frame element 2243 and the fourth frame element 2244. The bearing plate 22 has a second journal having the second opening 2202 for the fastening of the bearing plate to the second transverse rod 272, the journal being disposed first between the third rib 2223 and the fourth rib 2224 and second between the first frame element 2241 and the second frame element 2242.

A third opening 2203 for the fastening of the spacer piece which is disposed at the bottom is incorporated into a third journal which is disposed between the last frame element and the penultimate frame element at the end of the bearing plate 22 and between the first rib 2221 and the second rib 2222. A fourth opening 2204 for the fastening of the spacer piece 204 is incorporated into a fourth journal which is disposed between the last frame element and the penultimate frame element at the left hand end of the bearing plate 22 and on the fourth rib 2224 near the penultimate frame element. Between the second rib 2222 and the third rib 2223, the first frame element 2241 at the right hand end of the bearing plate 22 carries a fifth journal having a fifth opening 2205 for the fastening of the bearing shaft of the drive roller 5. The frame elements and ribs of the bearing plate 22 form nodes at their intersections, in the vicinity of which mounting of spacer pieces in openings is particularly fixed and stable. Thus, in the example which is shown, a sixth journal having a sixth opening 2206 for the fastening of the bearing shaft of the drive roller 6 is incorporated exactly into the node between the last frame element at the left hand end of the bearing plate 22 and the third rib 2223. A seventh opening 2207 for the fastening of a bearing shaft of the deflecting roller 7 is incorporated into a seventh journal which is disposed between the first frame element 2241 and the second frame element 2242 at the right hand end of the bearing plate 22 and between the first rib 2221 and the second rib 2222. An eighth opening 2208 for the fastening of the spacer piece 208 is incorporated into an eighth journal which is disposed between the first frame element 2241 and the second frame element 2242 at the right hand end of the bearing plate 22 and between the third rib 2223 and the fourth rib 2224 near the second frame element.

A ninth opening 2209 for the fastening of a locking pin 209 is incorporated into a ninth journal which is disposed between the last frame element and the penultimate frame element at the left hand end of the bearing plate 22 and between the third rib 2223 and the fourth rib 2224 near the fourth rib 2224.

Figure 2:
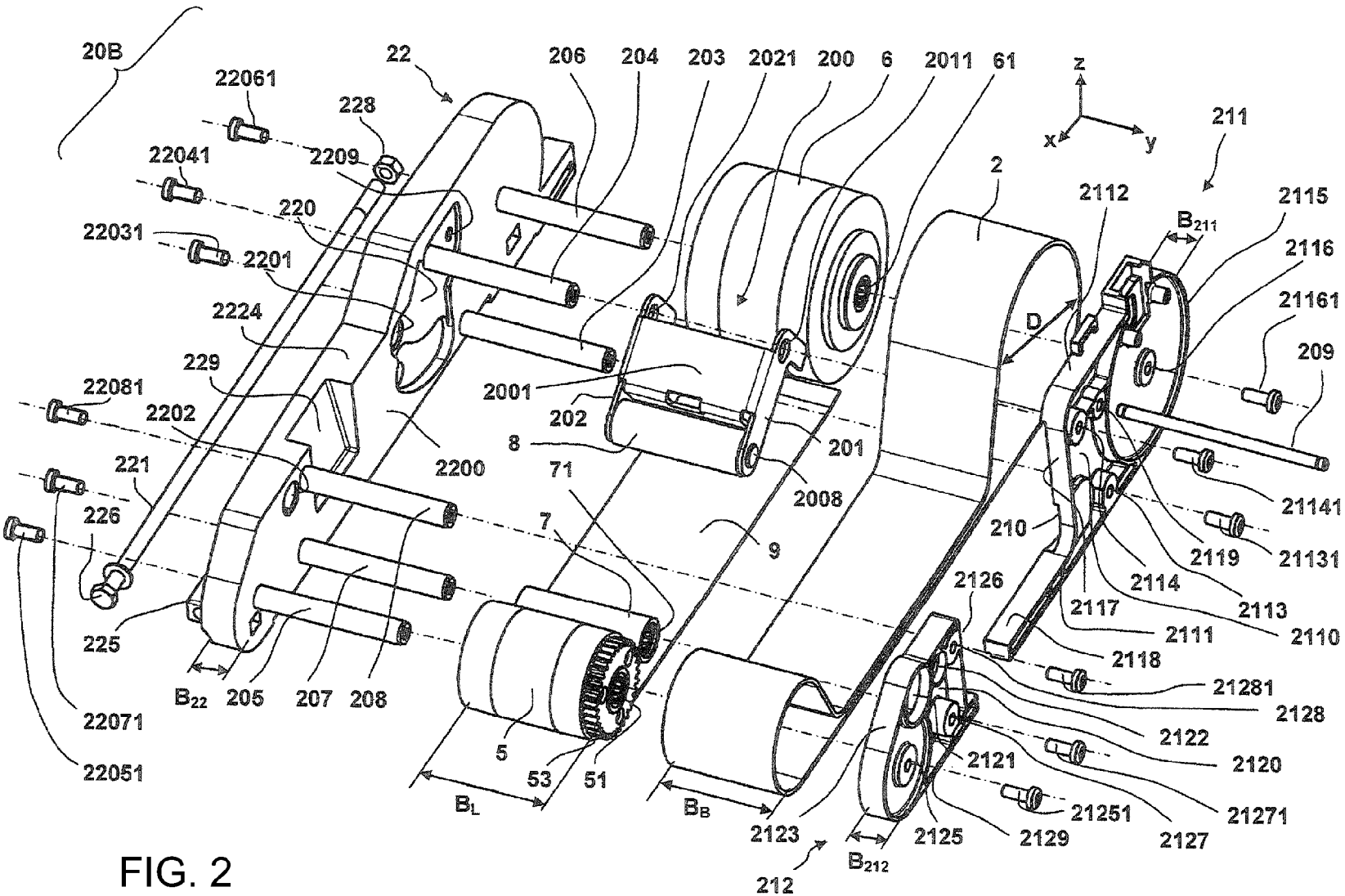
FIG. 2 is an exploded, perspective view of the proposed transport apparatus, as seen from the top rear right.

FIG. 2 shows a perspective view of the proposed transport apparatus 20B, from the top rear right in an exploded illustration.

In the zx plane, the first shaped part plate 211 has a smooth base plate 2110 on the inner side which faces the transport belt, having a cavity 210 of the base plate for a belt tensioning mechanism. An edge strip 2115 which is molded on the outer side of the base plate in the y direction has a width B.sub.211 and is bent upstream in the mail stream to form a semicircle. The length of the latter corresponds approximately to half the circumference U of the roller 6, wherein the following is true: L.apprxeq. ½U, where U=.pi.D. The diameter D is greater than the width B.sub.211 by the factor k, wherein the following is true: D=kB.sub.211, where k=3 to 10. The width B.sub.211 is oriented according to the material parameters and is greater in the case of a low strength of the material than in the case of high strength. On that half of the base plate which is of box-shaped configuration and extends in the x direction, journals having holes are disposed outside the circumference, the base plate 2110 being delimited to the bottom by a straight edge strip 2111 and to the top by a straight edge strip 2112, which both have the same width B.sub.211 and merge at their one end into the bent edge strip 2115. The upper straight edge strip 2112 falls in the x direction in a step 2117 onto a projection 2118 of the width B.sub.211 parallel to the lower edge strip 2111 at the other end of the first shaped part plate 211. The outer side of the base plate is structured by an outer structure, which reinforces the stability and strength of the shaped part plate 211 in a manner known per se under loading which occurs, in particular, when the transport belt 2 is tensioned. The journals having openings are molded on the outer side in the y direction, the journals and the outer structure not protruding beyond the edge strips in terms of their width. The journals, outer structure and the width of the edge strips extend parallel to the y direction if the shaped part plate 211 with the bearing plate 22 is fastened to the drive apparatus of the transport apparatus in a manner which is completed to form the roller carrier 20. The openings in the journals then likewise lie parallel to the y direction. The number of openings of the first and second shaped part plates 211 and 212 corresponds approximately to the number of openings of the bearing plate 22 for the spacer pieces 203, 204, 206 and 205, 207, 208 and for further components, such as for the locking pin 209 etc. and for the non-illustrated right hand transverse rod of the drive apparatus of the printing system. The spacer pieces 203, 204, 206 and 205, 207, 208 are fastened to the bearing plate 22 through fastening device 22031, 22041, 22061 and 22051, 22071, 22081. A corresponding opening 2113, 2114, 2116 and 2119 lies symmetrically in the y direction with respect to a plurality of non-illustrated openings of the bearing plate 22, in the first shaped part plate 211 for the spacer pieces 203, 204, 206 and for the locking pin 209, and a corresponding opening 2125, 2127, 2128 lies symmetrically in the y direction in the second shaped part plate 212 for the spacer pieces 205, 207, 208.

The first shaped part plate 211 carries a sixth opening 2116, centrally in a journal, and the edge strip 2115 which extends around the sixth opening 2116 at a radius which is, for example, approximately equal to that of the drive roller 6, the sixth opening 2116 being provided for fastening the bearing shaft 206 of the driven roller 6. For the spacer pieces 203, 204, 206, fastening device 21131, 21141, 21161 are provided for fastening the first shaped part plate 211.

A base plate 2120 of the shaped part plate 212, which base plate 2120 is smooth in the zx plane on the inner side which faces the transport belt, carries a total of five openings with integrally molded edge strips 2123, 2126 and 2129. Its width $B_{212}$ extends parallel to the y direction if the shaped part plate 212 with the bearing plate 22 is fastened to the drive apparatus of the transport apparatus in a manner which is completed to form the roller carrier 20. There is provision for the first opening 2121 of the second shaped part plate 212 to be configured with a sufficiently large cross section for a non-illustrated drive pinion and for the second opening 2122 to be configured with a sufficiently large cross section for the non-illustrated second transverse rod to be plugged through. The integrally molded edge strip 2123 delimits a fifth opening 2125 and both abovementioned openings 2121 and 2122 downstream in the mail stream, that is to say in the x direction and z direction (upward), and ends on one side with a straight edge strip 2126 on the mail input side, that is to say counter to the x direction, and on the other side with a lower straight edge strip 2129. All edge strips have the same width $B_{212}$ which is dimensioned in such a way that a grip protection is provided with respect to the drive pinion.

For the spacer pieces 205, 207, 208, openings 2125, 2127, 2128 in the second shaped part plate 212 and fastening device 21251, 21271, 21281 are provided for fastening to the second shaped part plate 212. In order to mount the roller carrier 20 of the transport apparatus, the spacer pieces 203, 204, 206 and 205, 207, 208 are fastened to the bearing plate 22, and the supporting plate 9 is plugged between the loop of the transport belt 2 and placed onto the bearing plate 22.

The supporting plate 9 has a sliding face on the side which faces the transport belt 2, that is to say on that side of the supporting plate 9, against which the transport belt 2 is pressed over a large surface area. The sliding face has a low coefficient of friction between the sliding face of the supporting plate and the running side of the transport belt 2 in the range $0.1\cdot10^{-6}<\mu<0.3\cdot10^{-6}$. This reduces the friction and therefore the necessary energy which is used to move the transport belt 2. Different materials can be used to provide the sliding face of the supporting plate, for example plastic and/or metallic materials. As an alternative, sliding films can be applied by adhesive bonding or sliding layers can be produced by polishing.

On the outer running face (transport side), the transport belt 2 has a rough structure and has adhesive properties. A very high coefficient of friction between the transport side and the flat material in the range $0.9\cdot10^{-6}<\mu<1.3\cdot10^{-6}$ is advantageous, in order to transport the letter without slip as far as possible, which has a decisive influence on the print quality.

In contrast, the drive roller 5 has a medium coefficient of friction of at least $\mu=0.5\cdot10^{-6}$ on the circumferential surface, on which the transport belt 2 runs with its running side. In order to transmit the introduced drive power to the transport belt with low slip, in addition rough structures can be applied or adhesive properties can be produced. The circumferential surface can be roughened, for example, by sand blasting, which advantageously prevents slip of the transport belt 2. Likewise, partially or completely applied rubber coatings on the circumferential surface are suitable. As a result, the sliding friction can be increased as far as $\mu=0.8\cdot10^{-6}$.

The high wraparound angle of the transport belt 2 around the drive roller 5, which wraparound angle is produced structurally by the deflecting rollers, is greater than 230° and therefore additionally prevents the slip of the transport belt. The driven roller 6 is advantageously provided with a greater diameter than the drive roller 5, in order for it to be possible to insert flat materials of up to 10 mm in thickness easily into the transport apparatus. The required drive energy during the insertion of thicker flat materials is likewise reduced by the resulting flatter wedge angle.

A belt tensioning mechanism is configured as a rocker 200. The latter includes two angled levers 201 and 202 which lie on the outside, are spaced apart from one another through a center plate 2001 and carry a bearing shaft 2008 having the deflecting roller 8 at one end of the lever arm. The respective other lever arm of the angled levers 201, 202 is angled away centrally by approximately 90° and serves for locking purposes together with the locking pin 209. In the angled away region, the angled levers 201, 202 carry in each case one opening 2011, 2021 for mounting on the spacer piece 204 which is configured as a bearing shaft.

During the mounting, the rollers 5, 6, 7 and the rocker 200 are plugged onto the spacer pieces 205, 206, 207 and 208 which are configured as bearing shafts, the transport belt 2 is placed onto the rollers and the shaped part plates 211 and 212 having the smooth inner side which faces the transport belt are then placed on and fastened. The rollers 5, 6 and 7 have a running face with the width $B_L>B_B$ (width of the transport belt) and have in each case centrally a needle bearing on their two sides. Only the needle bearings 51, 61 and 71 on the rear side can be seen in FIG. 2. In addition, the drive roller 5 has an external toothing system 53 which protrudes into an opening (not visible) of the base plate 2120 of the second shaped part plate 212. The transport belt 2 wraps around the rollers 5, 6 which are disposed at the ends of the roller carrier, due to the deflecting rollers 7, 8 which press onto the oval loop from above. The transport belt is guided along below the non-illustrated pressing device on both directions, the pulling run of the transport belt being supported from the center of the transport apparatus in the transport direction by the downwardly pointing smooth supporting plate 9.

After mounting, the rocker 200 is mounted rotatably on the bearing shaft 204 and is disposed between the first shaped part plate 211 and the bearing plate 22. The bearing plate 22 and the first shaped part plate 211 both have a cavity 220 and 210 molded on that smooth inner side of the base plates 2200 and 2110 which faces the transport belt.

The cavities are required to move the rocker 200 when the transport belt is mounted on the roller carrier 20. The roller carrier 20 carries a number of rollers, on which the transport belt 2 is tensioned through the use of the rocker 200, the rocker 200 being fixed through the use of the locking pin 209. The first shaped part plate 211 has a hole 2119 and the bearing plate 22 has a hole 2209 for plugging through the locking pin 209. The first and second shaped part plates 211, 212 can have in each case one edge of smaller width than the width $B_{22}$ of the edge of the bearing plate 22 at its ends. The bearing plate has a first and second hole 2201 and 2202 for fastening the transport apparatus to the associated drive apparatus. In the region between the two holes, the flexural strength of the bearing plate 22 is predetermined in a defined manner by a constructed reinforcement and/or weakening of the structure. A constructed reinforcement is achieved by an increased width of the edge strip 2224 and a constructed weakening of the structure of the bearing plate 22 is achieved by a reduced width of the edge strip in the region of the cavity 229.

The bearing plate 22 has at least one inwardly smooth base plate 2200 with edge strips which are bent forward for reinforcing and producing a sufficient torsional rigidity, stressing device 225, (227 concealed) and stressing and setting device 226, 228 as well as a pull rod 221 on the front side, in order to absorb the tensile forces which act on the bearing plate 22 during tensioning of the transport belt 2 and in order to compensate for or set the torsion or deflection of the bearing plate in a defined manner. It is advantageous if the pull rod 221 is configured as a hexagon bolt. The stressing and setting device 226 is configured as a bolt head and the stressing and setting device 228 is configured as a bolt nut.

As an alternative, a defined deflection of the bearing plate 22 can be achieved by a determined sequence and configuration of a plurality of reinforcements and weakenings of the structure of the bearing plate 22. As a result, under loading, a profile of the deflection of the bearing plate 22 can be achieved according to a defined mathematical function. For example, a deflection of the bearing plate 22 with a logarithmic or potential profile is just as possible as an absolutely rectilinearly uniform profile.

Figures 3, 4C:
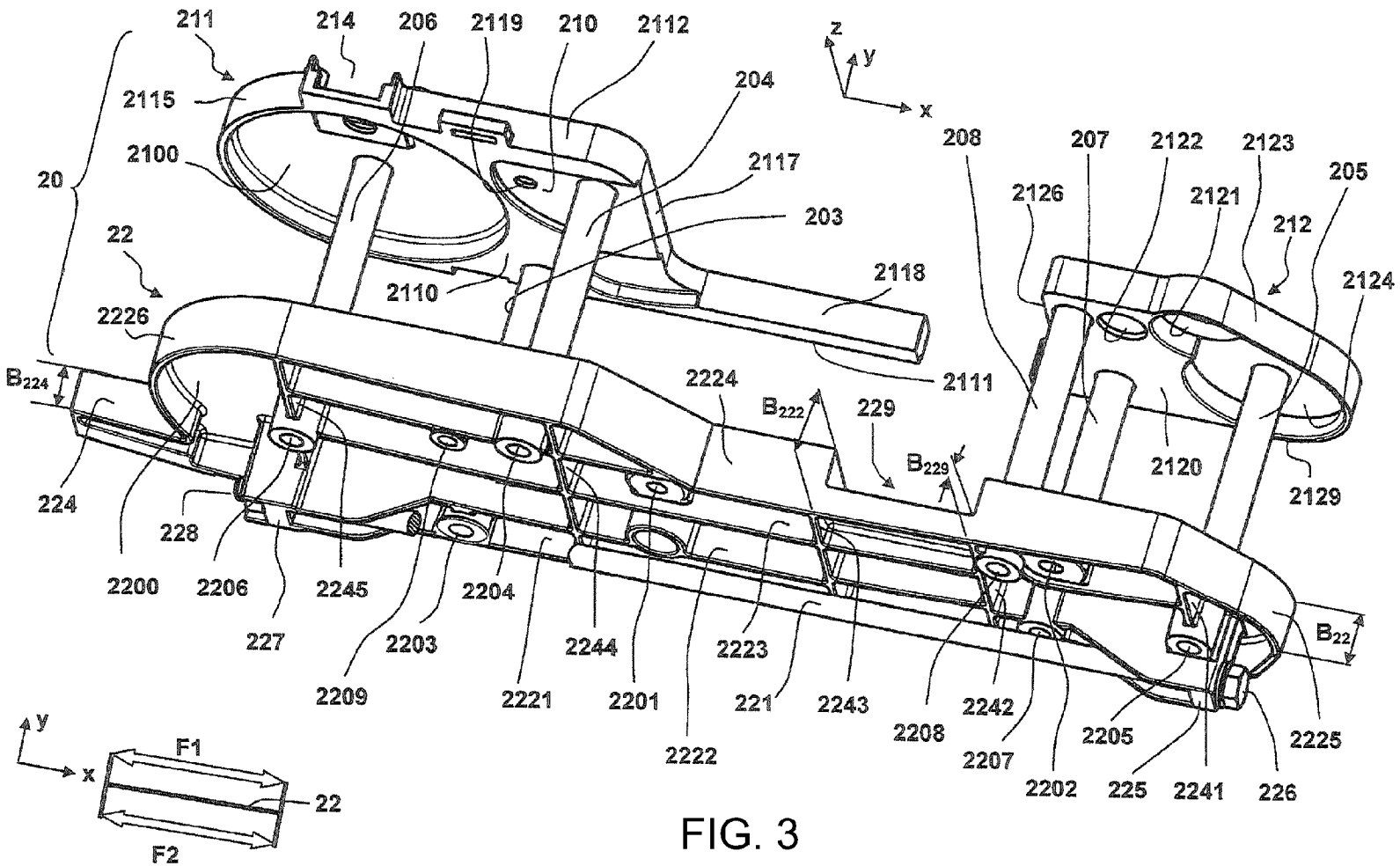
FIG. 3 is a perspective view of a roller carrier of the transport apparatus, as seen from the top front right.
FIG. 4C is a diagram illustrating the action of forces.

FIG. 3 shows a perspective view of the roller carrier of the transport apparatus, from the top front right. The roller carrier 20 includes the bearing plate 22, the first shaped part plate 211 and the second shaped part plate 212, as well as the spacer pieces 203, 204, 206 and 205, 207, 208. On the inner side which faces the transport belt, the base plate 2110 of the first shaped part plate 211 has a cylindrical pocket 2100 which is disposed circularly around the spacer piece 206 and on the left next to the cavity 210 for the belt tensioning mechanism. A compartment 214 which is accessible from above for an electronic assembly is made between the edge strips 2112 and 2115. A hole 2119 for the locking pin is made in the base plate 2110 in the region of the cavity 210 near the compartment 214. The cavity 210 is open toward the edge strip 2117 down as far as the projection 2118 which is disposed parallel to the lower edge strip 2111.

On the inner side which faces the transport belt, the base plate 2120 of the second shaped part plate 212 has a cylindrical pocket 2124 which is disposed circularly around the spacer piece 205 and on the left next to the first opening 2121 in such proximity that the opening merges into the pocket, while the first opening 2121 is spaced apart from the second opening 2122. The pocket 2124 is delimited to the bottom by the edge strip 2129, and the first opening 2121 and the pocket 2124 are delimited to the right and to the top by the edge strip 2123. The base plate 2120 is delimited to the left by the edge strip 2126.

The bearing plate 22 has a supporting web 224 which is integrally molded downstream in the mail stream, has a width $B_{224}$ and merges seamlessly on one side into the lower edge strip 2221 in a downward direction (to the table plate), the edge strip 2221 delimiting the base plate 2200 to the bottom and being configured to the front with a width which rises in the x direction as far as the center.

On the other side, the edge strip 2226 is connected to the supporting web 224 at the left hand end of the bearing plate 22, which edge strip 2226 delimits the base plate 2200 to the top as far as the center of the bearing plate 22 and is likewise configured to the front with a width which rises in the x direction as far as the center. An edge strip 2224 which is disposed in the center section of the bearing plate 22, delimits the base plate 2200 to the top and is configured to the front with a greater width $B_{222}>B_{224}$ merges seamlessly and in a ramp-like manner into the upper edge strip 2226. At the same time, the outer edge strips 2221 and 2224 can also be ribs of a structure which is shaped out to the front on the base plate 2200, the ribs extending in the x direction. A reinforcement of the structure is achieved by integrally molded ribs 2221, 2222, 2223 and 2224 and frame elements 2241, 2242, 2243, 2244 and 2245 which form a cell structure, the frame elements extending in the y direction.

As an alternative, a honeycomb structure is conceivable which has side walls which do not lie parallel to the axes of the Cartesian coordinate system, that is to say which have a different profile than that described above.

A weakening of the structure is made in the edge strip 2224 which delimits the base plate 2200 to the top in the center region of the bearing plate 22. In this case, the weakening is achieved by a compartment-shaped cavity 229 on the inner side of the base plate 2200, which cavity 229 reduces the width of the upper edge strip and the width of the ribs between the second frame element 2242 and the third frame element 2243 to the width $B_{229}$.

As an alternative, a weakening of the structure in another way is conceivable, such as a reduction of the wall thickness of the cell or honeycomb walls in coordination with the material parameters (for example, modulus of elasticity).

First, the edge strip 2221 which delimits the base plate 2200 to the bottom and the edge strip 2224 which delimits the base plate 2200 to the top in the center region of the bearing plate 22 merge into an edge strip 2225 which lies downstream in the mail stream. Second, the width of the edge strips 2221 and 2224 which are configured to the front can be reduced from the width $B_{222}$ to the width $B_{22}$ in the x direction between the second and first frame elements.

Journals which are connected to the cell or honeycomb structure and have openings 2201, 2202, . . . 2209 are integrally molded on the base plate 2200, and stressing device 225 and 227 are integrally molded near the bearing points of the drive and driven rollers. The pull rod 221 is shown in section on one side, in order to clarify the position of the opening 2203 and its configuration in a journal, whereas the position of the opening 2207 and its configuration in a journal is covered by the pull rod 221 which is shown in unsectioned form there.

The width of the second rib is increased at its two ends and merges into the stressing device 225 and 227 which protrude beyond the structure to the front and have in each case one opening for a pull rod 221 which can be plugged in in the x direction on the front side of the bearing plate 22. The pull rod 221 is stressed on the front side through the use of stressing and setting device 226, 228, in order to absorb the tensile forces which act on the bearing plate 22 during tensioning of the transport belt 2. In this way, it is possible to compensate for or set the torsion or deflection of the bearing plate in a defined manner.

Although the bearing plate 22 has a honeycomb or cell structure on the front side, which contributes to the saving of material and weight, it is nevertheless not constructed to be free of deflections and low in torsion. In contrast, it permits a defined deflection.

Figure 4A:
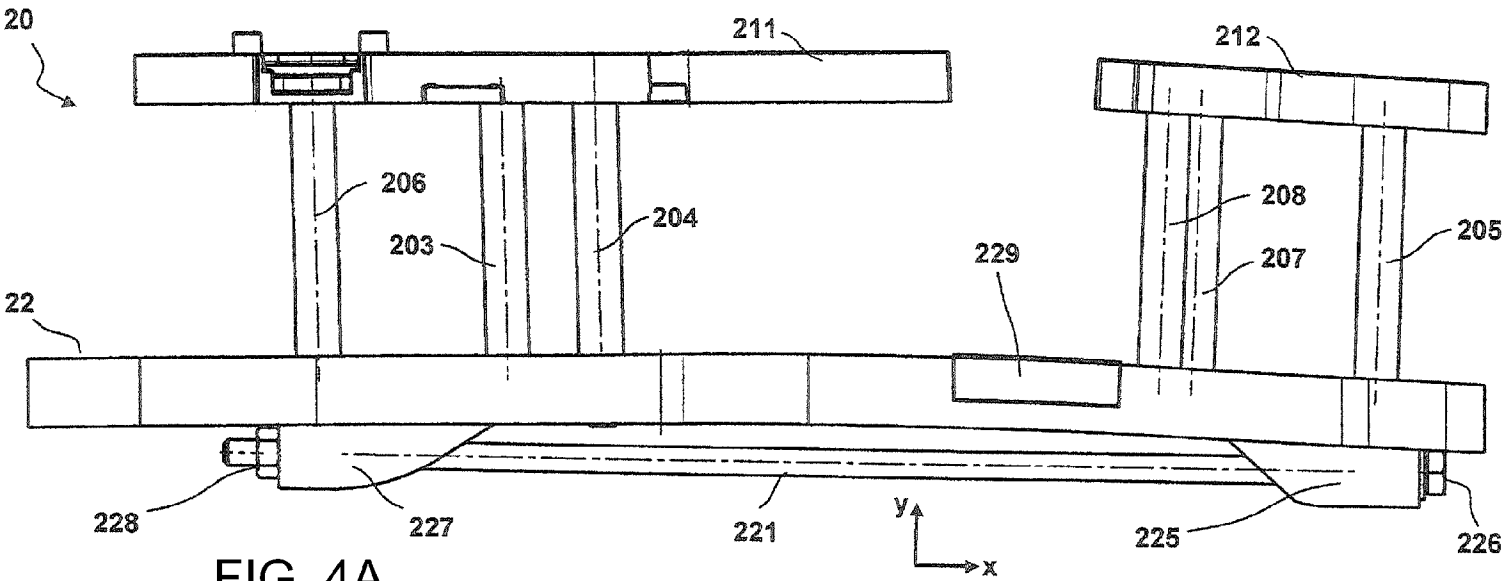
FIG. 4A is a plan view of the roller carrier of the transport apparatus, in which the roller carrier is bent concavely in the y direction.

FIG. 4A shows a plan view of the roller carrier of the transport apparatus, which roller carrier is bent concavely in the y direction. A deflection of this type (shown in exaggerated form) of the roller carrier 20 is produced during corresponding loading by a mechanical tensile stress which is exerted by the pull rod 221 and is transmitted to the two ends of the bearing plate 22 through the stressing device 225 and 227. The tensile stress can be set through the stressing and setting device 226, 228. The first shaped part plate 211 and the second shaped part plate 221 are fastened to the bearing plate 22 through the spacer parts 203, 204, 206 and 205, 207, 208. This can take place by screwing or a press-in connection.

FIG. 4C shows a diagrammatic illustration of the action of forces on the bearing plate 22. The first tensile stress force F1 which is exerted by the mechanical tensile stress in the case of a mounted transport belt through the spacer pieces to the bearing plate 22 is counteracted by an adjustable second tensile stress force F2 which is applied by a pull rod which is mounted on the outer side of the bearing plate.

Figure 4B:
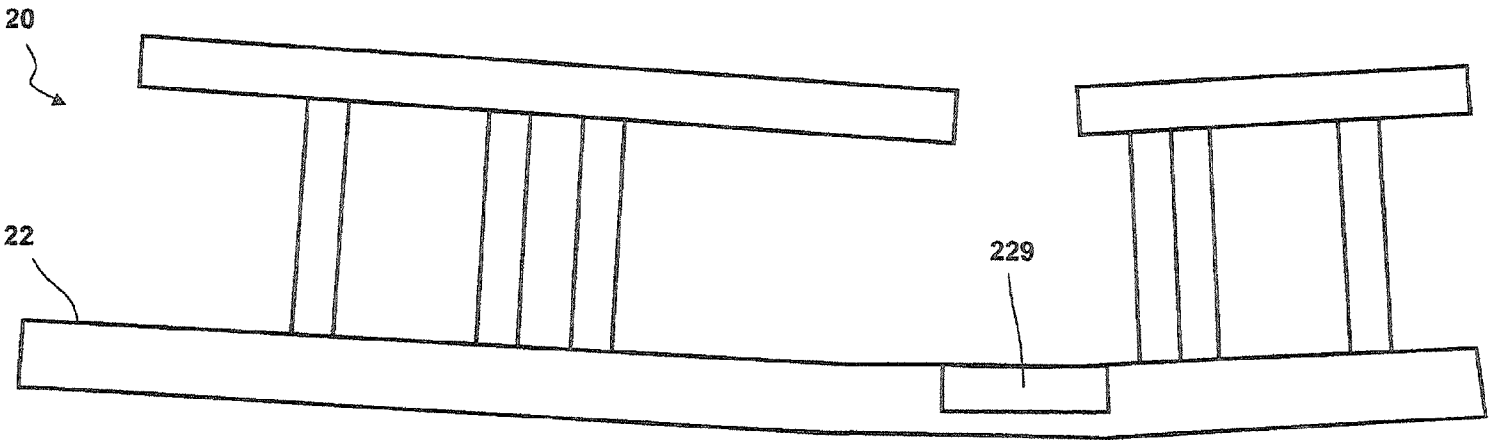
FIG. 4B is a plan view of the convexly bent roller carriers of the transport apparatus.

FIG. 4B shows a plan view of the convexly bent roller carriers of the transport apparatus. A deflection of this type (shown in exaggerated form) of the roller carrier 20 is produced during corresponding loading of the rollers by a mechanical tensile stress of the mounted transport belt. A flat belt is used in this case as transport belt.

The first tensile stress force F1 and second tensile stress force F2 which act on one side cause an intended deflection of the bearing plate 22 according to FIG. 4A or 4B by the pull rod 221 depending on the belt tensioning force or tensile stress. In the case of concavely bent roller carriers according to FIG. 4A, the spacer pieces which are fixed on the left and right and are configured as bearing shafts for the deflecting rollers no longer stand perpendicularly and parallel to one another and tilt inward. However, those spacer pieces which are connected to the same shaped part also continue to be axially parallel to one another. The flat belt does not find a stable running track as long as the belt tensile forces cannot be distributed uniformly to the belt width. That is to say, a mounted transport belt runs intentionally toward the shaped part plates due to those groups of spacer pieces which do not stand axially parallel with respect to one another at the two ends of the bearing plate 22. As a result of an opposing force apparatus having a threaded pull rod which is disposed on the outside on the opposite side of the bearing plate side, an opposing force for belt tensioning can be built up by rotation on the stressing and setting device 226 of the threaded pull rod 221. As a result, the deflection of the bearing plate decreases and can also move in the opposite deflection direction. As a result, it now becomes possible to adjust the desired belt track position when the belt is driven. The advantages are that no additional adjustable belt track elements have to be used and all those bearing shafts, on which the rollers roll, act at the same time as belt track elements. The fixed bearing shafts likewise do not need to be disposed precisely with respect to one another in an expensive manner. In addition, the bearing plate does not have to be readjusted in the case of a higher belt tension because the opposing force apparatus compensates for the deflection. This makes an inexpensive and simple construction possible.

For example, the bearing plate has in each case three fixed spacer pieces which are configured as bearing shafts pressed in fixedly at the left hand and right hand ends of the bearing plate. These serve to fasten the first and second shaped part plates on the left hand and right hand ends of the bearing plates on the end side (by way of a screw connection). This produces three point fastening which prevents the shaped part plates turning with respect to the bearing plate.

The deflecting rollers are preferably of cambered configuration or are cylindrical and are provided with in each case one bevel at the edges. They stabilize the running track of the transport belt additionally against transversely introduced lateral forces and disruptions, which has a direct positive effect on the print quality. The transport belt likewise runs more quickly back into its preset track again and makes setting and adjusting easier.

The flat belt having a woven fabric insert has a predefined belt length and tolerance, and likewise a predefined tensile force for 1% belt extension, which results in a known belt length.

This stipulates precisely the axial spacings of the deflecting rollers on the bearing plate. One of the deflecting rollers is mounted in the rocker. The rocker is mounted such that it can be pivoted away. If the belt is placed on it, the rocker is released from its locking and pivoted away; the shaped part plates are likewise not yet mounted, with the result that the belt can be inserted easily. The shaped part plates are mounted, and subsequently the rocker is pivoted back into its locking again and tensions the belt automatically to its optimum belt tension. In this case, the locking takes place through a plug-in axle. In order to change the belt, the transport unit is removed from the machine and the plug-in axle for locking the belt tensioner is removed. Subsequently, the shaped part plates are removed. The belt tensioner is pivoted away and the belt can then be changed easily. The transport unit is reassembled in the reverse order.

After the installation in the machine, the drive is activated and the belt track position is set by adjustment of the opposing force device. This can be done on site at the customer's location by a service technician. The stressing and setting device of the pull rod are advantageously configured as a screw or nut, by way of which the track position of the transport belt can be adjusted freely in a range from 0 to ±10 mm.

The transport apparatus is used with a printing module in a printing unit which is controlled by microprocessor, for example in a franking machine, for transporting mail items. As is known, a franking machine includes (in a manner which is not shown), inter alia, an electronic part (meter) and the mail item transport apparatus having an electronic controller and a pressing apparatus. The pressing apparatus which presses against the mail item from below in a sprung manner is disposed below a feed table which is known per se. A keyboard and a display unit of the meter are connected to the electronic meter in a manner which is known but not shown. As is known, the electronic controller is connected first to an encoder and second to a motor of the mail item transport apparatus for actuating it in a manner which is not shown.

The invention is not restricted to the present embodiment per se. Rather, a number of units are conceivable within the scope of the claims, which units are used and are included in the present claims, proceeding from the same basic concept of the invention.

The invention claimed is:

1. A transport apparatus for flat materials which are to be printed, the transport apparatus comprising:

rollers;

a driven transport belt mounted on said rollers;

a roller carrier having a bearing plate with a first end and a second end;

a first shaped part plate;

a second shaped part plate;

a first number of spacer pieces disposed on a first side between said first end of said bearing plate of said roller carrier and said first shaped part plate;

a second number of spacer pieces disposed on a second side between said second end of said bearing plate and said second shaped part plate;

a pull rod having a stressing and setting device; and a stressing device attached to said first and second ends of said bearing plate and configured for a transmission of force from said pull rod, a mechanical tensile stress being transmitted through said stressing device to said first and second ends of said bearing plate for a defined deflection of said roller carrier with corresponding loading of said bearing plate, and in that said stressing and setting device of said pull rod provided for setting the mechanical tensile stress.

2. The transport apparatus according to claim 1, wherein said first and second spacer pieces are all of identical configuration.

3. The transport apparatus according to claim 1, wherein said first and second spacer pieces are all configured identically as bearing shafts and, for setting a track in each case said first and second spacer pieces lie axially parallel to one another at a same end of said roller carrier.

4. The transport apparatus according to claim 1, further comprising a rocker being a stressing mechanism for said transport belt; and wherein one of said first spacer pieces is configured as a bearing shaft for said rocker, and said second spacer pieces are configured as bearing shafts for said rollers for said transport belt.

5. The transport apparatus according to claim 4, wherein said rocker includes a center plate, a bearing shaft, a locking pin, a deflecting roller and two angled levers each with a first lever arm and a second lever arm, said angled levers lie on an outside, and are spaced apart from one another through said center plate and carry said bearing shaft with said deflecting roller at one end of said first lever arm, said second lever arm of said angled levers being angled away centrally by approximately 90° serving for locking together with said locking pin, said angled levers having in each case one opening formed therein in an angled away region for mounting on one of said first spacer pieces which is configured as said bearing shaft.

6. The transport apparatus according to claim 1, wherein said bearing plate has a first hole formed therein and a second hole formed therein for fastening a transport apparatus to an associated drive apparatus, said bearing plate having a structure and a flexural strength of said bearing plate being predetermined in a defined manner in a region between said first and second holes by at least one of a constructed strengthening and weakening of said structure.

7. The transport apparatus according to claim 6, wherein said structure has regions including a strengthened region and a weakened lying next to one another.

8. The transport apparatus according to claim 6, wherein said structure has a defined sequence and configuration of a plurality of strengthening sections and at least one weakening section that enable said bearing plate to deflect.

9. The transport apparatus according to claim 8, wherein said weakening of said structure of said bearing plate is constructed by a reduction in a wall thickness of a cell in coordination with material parameters.

10. The transport apparatus according to claim 1, wherein said bearing plate has at least one base plate which is smooth on an inside and has edge strips which are bent forward for strengthening and producing a sufficient torsional rigidity, said stressing device, said pull rod and said stressing and setting device of said pull rod are disposed on a front side of said bearing plate, a constructed strengthening of said bearing plate being achieved by an increased width of at least one of said edge strips and a constructed weakening of a structure of said bearing plate being achieved by a reduced width of another one of said edge strips in a region of a cavity.

11. The transport apparatus according to claim 1, wherein said pull rod is a hexagon bolt.

12. The transport apparatus according to claim 1, wherein said stressing and setting device of said pull rod is configured as at least one of a screw and a nut, by way of which a track position of said transport belt can be adjusted freely in a range from 0 to ±10 mm.

13. The transport apparatus according to claim 1, wherein in each case one of said first and second shaped part plates rests on said spacer pieces at in each case three points at said first and second ends of said bearing plate, as a result of which a stable and low torsion mounting of said first and second shaped part plates is achieved through said spacer pieces at said first and second ends.

14. The transport apparatus according to claim 13, wherein a three point fastening operation is carried out for each of said first and second shaped part plates at said first and second ends of said bearing plate.

15. A transport apparatus for flat materials which are to be printed, the transport apparatus comprising:

rollers;

a driven transport belt mounted on said rollers;

a roller carrier having only a single bearing plate with a first end and a second end;

a first shaped part plate;

a second shaped part plate;

a first number of spacer pieces disposed on a first side between said first end of said bearing plate of said roller carrier and said first shaped part plate;

a second number of spacer pieces disposed on a second side between said second end of said bearing plate and said second shaped part plate;

a pull rod having a stressing and setting device; and a stressing device attached to said first and second ends of said bearing plate and configured for a transmission of force from said pull rod, a mechanical tensile stress being transmitted through said stressing device to said first and second ends of said bearing plate for a defined deflection of said roller carrier with corresponding loading of said bearing plate, and in that said stressing and setting device of said pull rod provided for setting the mechanical tensile stress.

* * * * *